US005918889A

United States Patent [19]

Tai

[11] Patent Number: 5,918,889

[45] Date of Patent: Jul. 6, 1999

[54] SHOCK ABSORBER FOR A SKATE

[76] Inventor: Chang Sheng Tai, No. 510, Sec. 5, Chung-Shin Road, San-Chung, Taipei, Taiwan

[21] Appl. No.: 09/050,257

[22] Filed: Mar. 30, 1998

[51] Int. Cl.[6] ..... A63C 17/02

[52] U.S. Cl. ..... 280/11.22; 280/11.28

[58] Field of Search ..... 280/11.22, 11.28, 280/11.27, 11.23, 11.115, 11.25, 11.19, 124.164

[56] References Cited

U.S. PATENT DOCUMENTS

| | | | |
|---|---|---|---|
| 302,503 | 7/1884 | Lincoln | 280/11.28 |
| 319,839 | 6/1885 | Nelson | 280/11.28 |
| 1,616,952 | 2/1927 | Dahl | 280/11.28 |
| 4,915,399 | 4/1990 | Marandel | 280/11.28 |
| 5,085,445 | 2/1992 | Boyden | 280/11.22 |
| 5,405,156 | 4/1995 | Gonella | 280/11.28 |

*Primary Examiner*—Lanna Mai
*Assistant Examiner*—David R. Dunn
*Attorney, Agent, or Firm*—Bacon & Thomas, PLLC

[57] ABSTRACT

An improved skate stage comprises a wheel bracket, a spring, a mounting plate and a U-shape member. The wheel bracket have two embedding grooves on the top side thereof, the embedding groove having a positioning shaft and a positioning plate within it. The U-shape member is arranged beside the embedding groove on the top side of the wheel bracket. The U-shape member has a round groove and a blocking groove on the top side thereof. The positioning shaft having, on the lateral side thereof, a lateral hole allowing the insertion of a positioning rod which pass through a slot of a rectangular shaft, and one end of the positioning rod being fixed by a bolt. The mounting plate is embedded within the embedding groove. The rectangular shaft below the mounting plate is fitted between the positioning shaft. The fixing plate beside the rectangular shaft clamps the positioning plate of the embedding groove. A groove is provided on the bottom side of the mounting plate and beside the rectangular shaft, and the groove accommodating the spring. Another end of the spring is placed within the round groove of the U-shape member to provide elasticity between the wheel bracket and the mounting plate. The shocking force of the wheel bracket can be minimized by the elastic force of the spring and the shifting of the U-shape member within the rectangular groove.

1 Claim, 6 Drawing Sheets

SHOCK ABSORBER FOR A SKATE

FIELD OF THE INVENTION

The present utility relates to a skate stage for a skating means, more particularly, to an improved skate stage for a skating means which has an anti-shocking effect by providing a spring means on the skating means.

DESCRIPTION OF PRIOR ART

The conventional skating means generally has two wheels on front and back side. However, this kind of skating means can not provide skating with good quality and comfort. Recently, an in-line roller skate has been developed to provide a better skating effect. However, in above-mentioned skating means, the wheels are directly mounted on the wheel bracket. Therefore, the shocking experienced by the wheels will directly transmit to the ankle of the user. It is liable to hurt the user.

The skating becomes a more and more attractive activity. However, the conventional skating means can not provide a safe use because they can not remove the shocking effect which may hurt the user. Therefore, a skating means with safe design is desirable.

SUMMARY OF THE INVENTION

It is an object of this invention to provide a mobile mounting plate on the skating means, wherein the mounting plate is equipped with a spring on a bottom side thereof such that the spring can minimize the shocking force.

It is another object of this invention to provide a fixing plate on the bottom side of a the mounting plate, the mounting plate will not slide over the skating stage to right or left direction by clamping the fixing plate on the positioning plate of an embedding groove.

It is still another object of this utility to provide a rectangular groove beside the embedding groove on the wheel bracket for the accommodation of a U-shape means, the U-shape means can move up or down within the rectangular groove.

BRIEF DESCRIPTION OF THE DRAWINGS

In order that the present invention may more readily be understood the following description is given, merely by way of example with reference to the accompanying drawings, in which.

DETAILED DESCRIPTION OF PREFERRED EMBODIMENT

Figure 1:
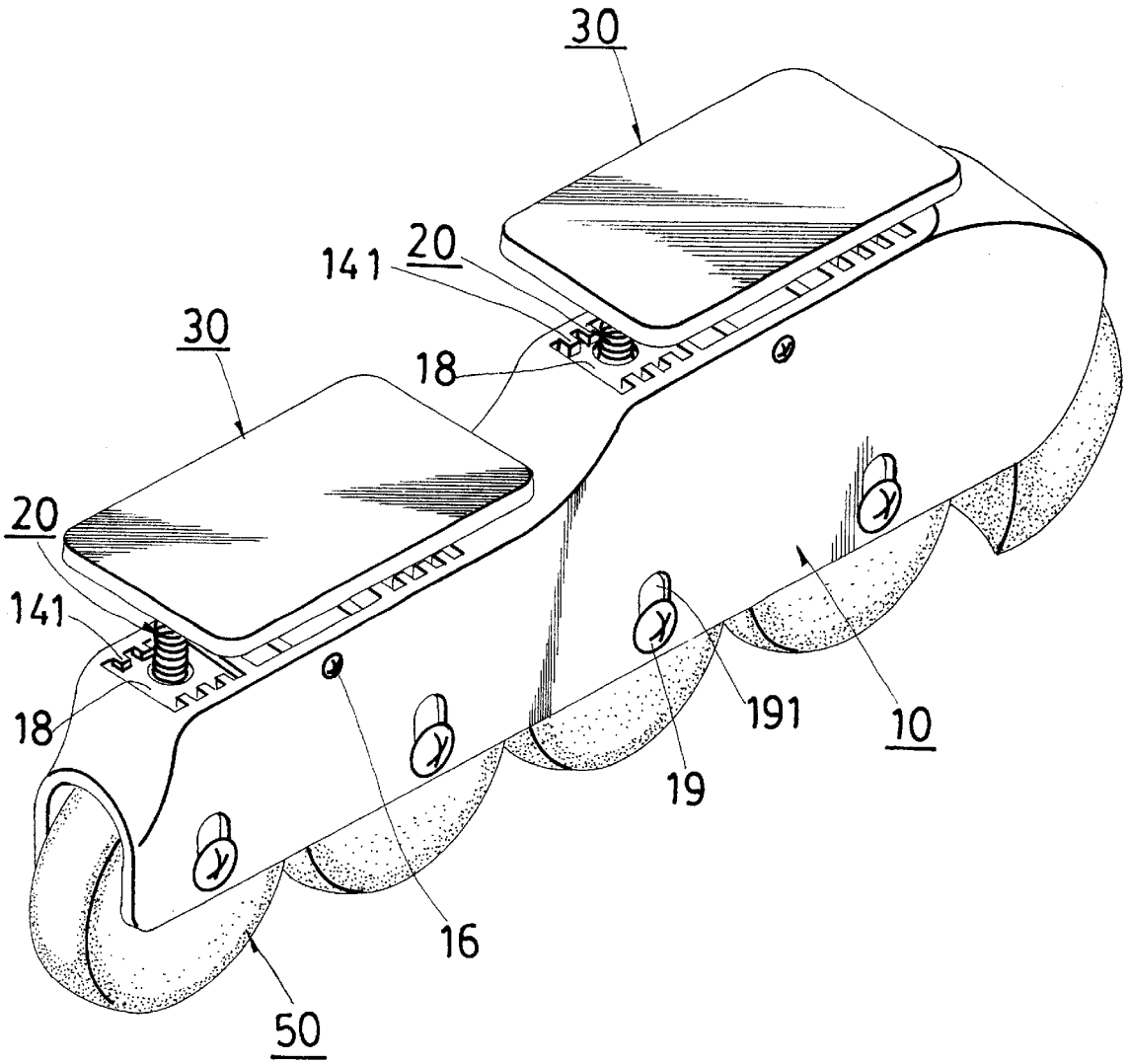
FIG. 1 is a perspective view of the present invention.
Figure 2:
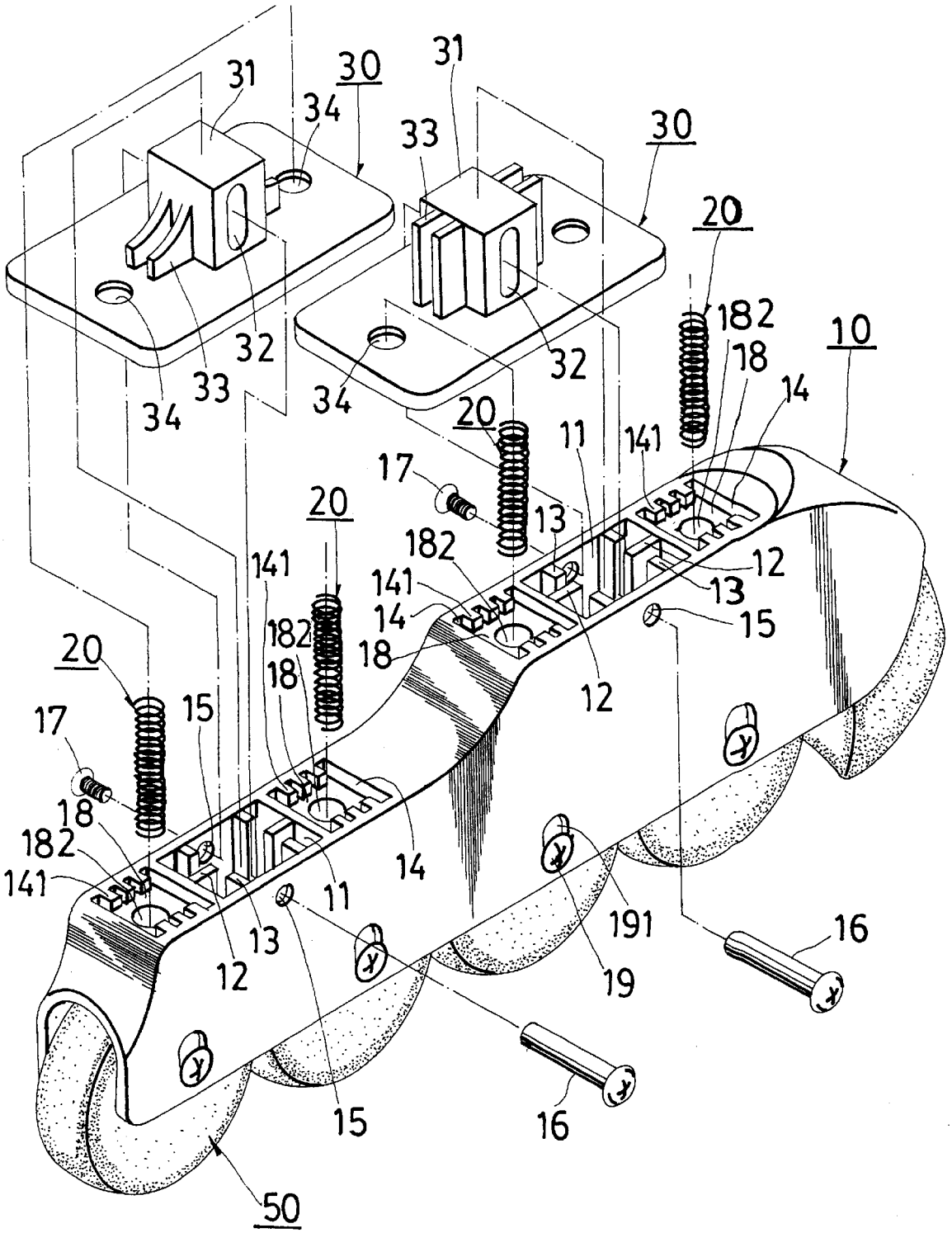
FIG. 2 is an exploded view of the present invention.
Figure 3:
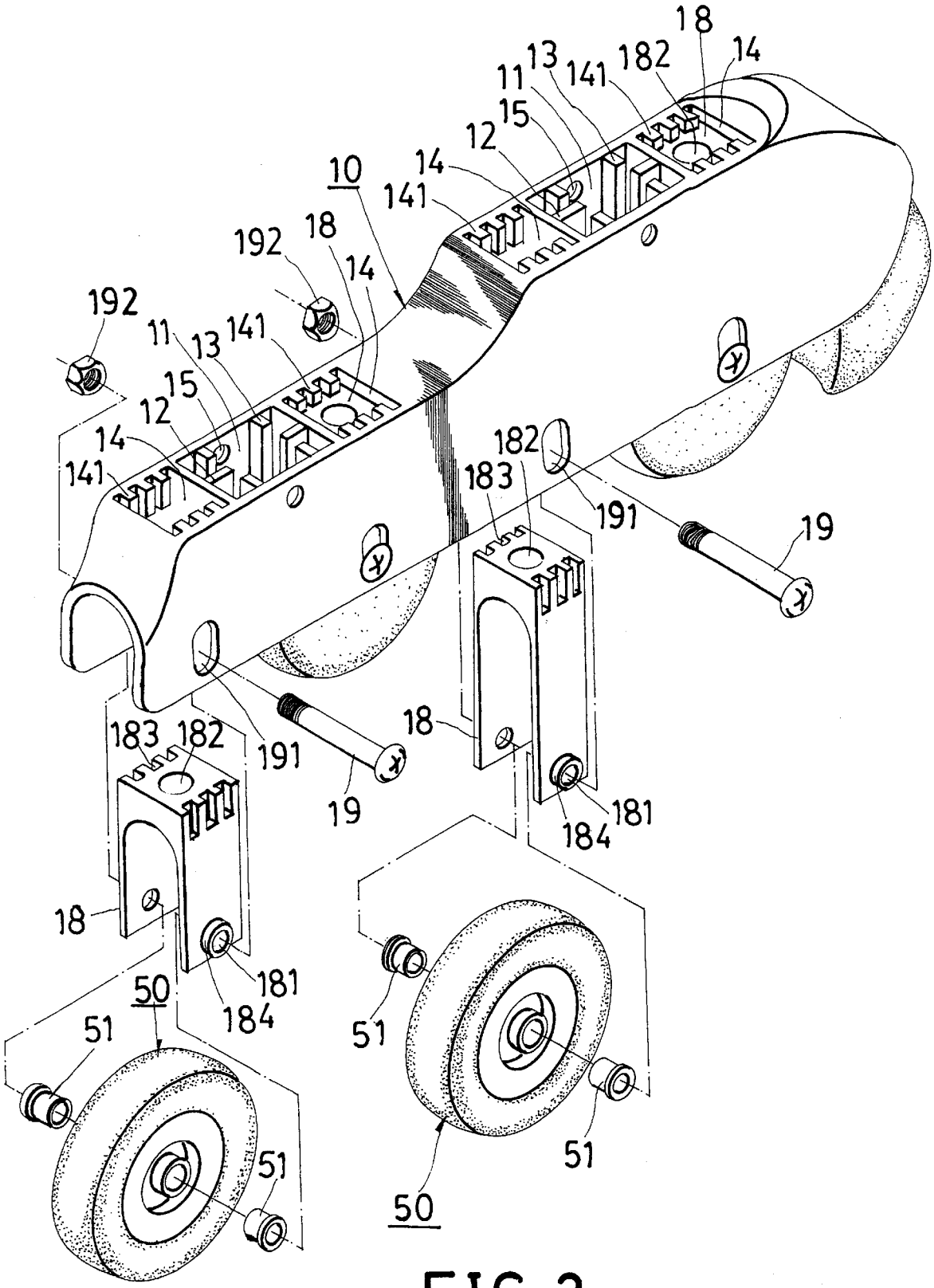
FIG. 3 the another exploded view of the present invention.

Referring to FIG. 1 to 3, the skating stage according to the present invention comprise a wheel bracket 10, a spring 20, a mounting plate 30, and a U-shape member 18, wherein:

the wheel bracket 10 have an embedding groove 11 on top side thereof, and a rectangular groove 14 beside the embedding groove 11, the rectangular groove 14 having a plurality of blocking piece 141 within it, the embedding groove 11 having a positioning shaft hole 13 and a positioning plate 12 within it, the positioning shaft hole 13 having, on the lateral side thereof, a lateral hole 15 allowing the insertion of a positioning rod 16, one end of the positioning rod 16 being fixed by a bolt 17;

the mounting plate 30 has U-shape means has a round groove and a blocking groove on top side thereof, which has a slot 32, on both sides of the rectangular shaft 31 being provided with fixing plate 33, a 34 recess being provided on the bottom surface of the mounting plate 30 and beside the rectangular shaft 31;

the U-shape member 18 has a round groove 182 and a blocking groove 183 on top side thereof, and a convex circle 184 on bottom side thereof, the convex circle 184 being provided with an axial hole 181.

The above-mentioned components are arranged in following way. The rectangular shaft 31 below the mounting plate 30 is inserted between the positioning shaft hole 13 of the embedding groove 11 on top of the wheel bracket 10. The positioning rod 16 penetrate into the lateral hole 15 on a lateral side of the wheel bracket 10, and penetrate through of the slot 32 of the rectangular shaft 31, and then penetrate out of the lateral hole 15 on another lateral side of the wheel bracket 10. The emerging end of the positioning rod 16 is fixed by a bolt 17. Therefore, the rectangular shaft 31 will not move slantingly within the positioning shaft hole 13, as shown in FIG. 2. The fixing plate 33 on the lateral side of the rectangular shaft 31 can clamp the positioning plate 12 within the embedding groove 11. The U-shape member 18 is inserted into the rectangular groove 14 of the wheel bracket 10, as shown in FIG. 3. The blocking piece 141 of the rectangular groove 14 can just fit into the blocking groove 183 of the U-shape member 18. The convex circle 184 below the U-shape member 18 is inserted into a groove hole 191 below the wheel bracket 10 wherein the axial hole 181 of the convex circle 184 allow the penetration of the bolt 19. The bolt 19 penetrate the groove hole 191 beside the wheel bracket 10 and the ring 51 of the wheel 50 such that the U-shape member 18 and the wheel 50 can be locked between the groove hole 191 of the wheel bracket 10. Furthermore, the spring 20 is arranged between the recess 34 of the mounting plate 30 and the round recess 182 of the U-shape member 18 to provide elasticity between the wheel bracket 10 and the mounting plate 30, as shown in FIG. 2. The shocking force of the wheel bracket 10 can be minimized by the elastic force of the spring 20 and the shift of the U-shape member 18 within the rectangular groove 14.

Figure 4:
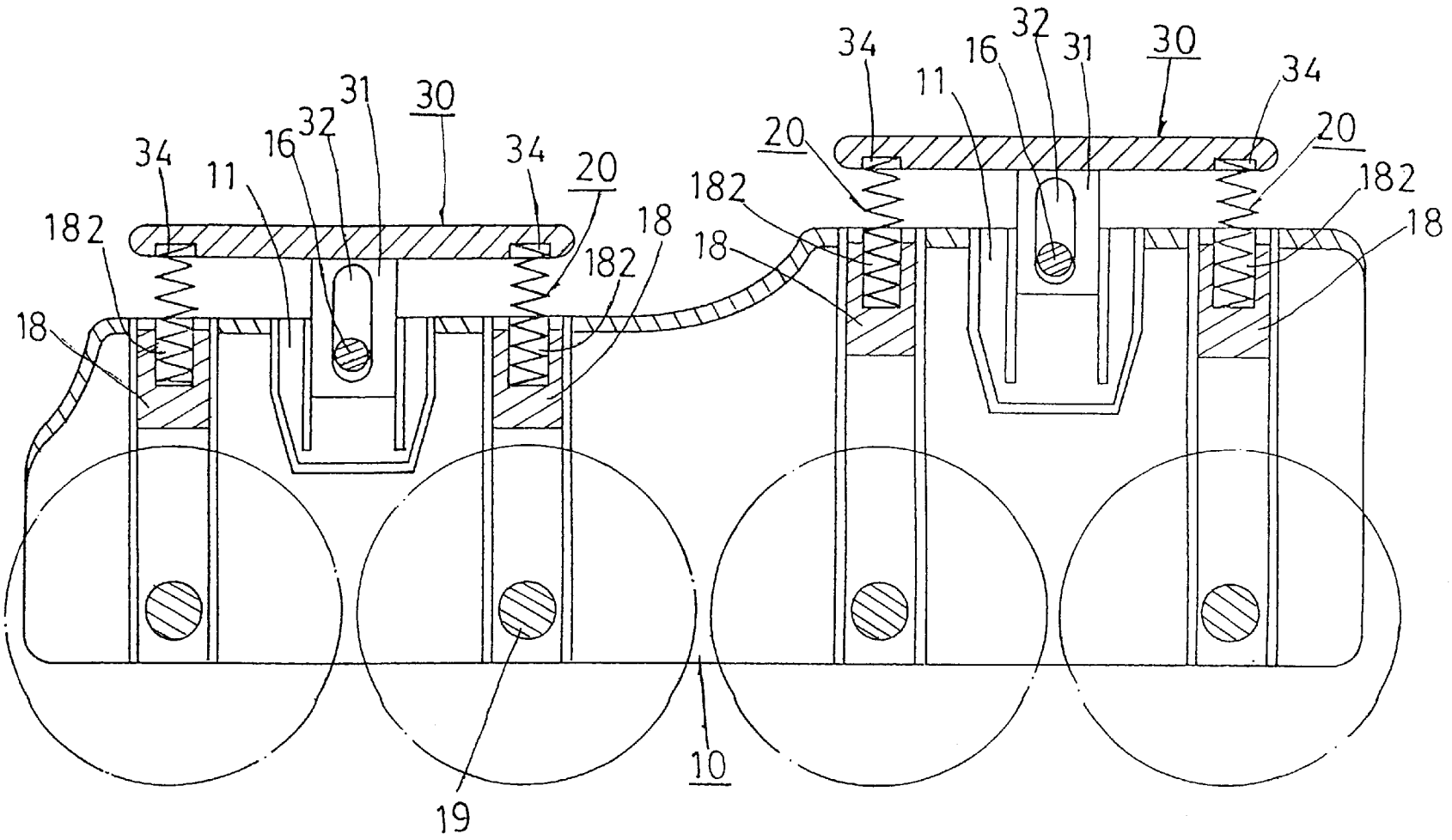
FIG. 4 is a cross section view of the present invention.
Figure 5:
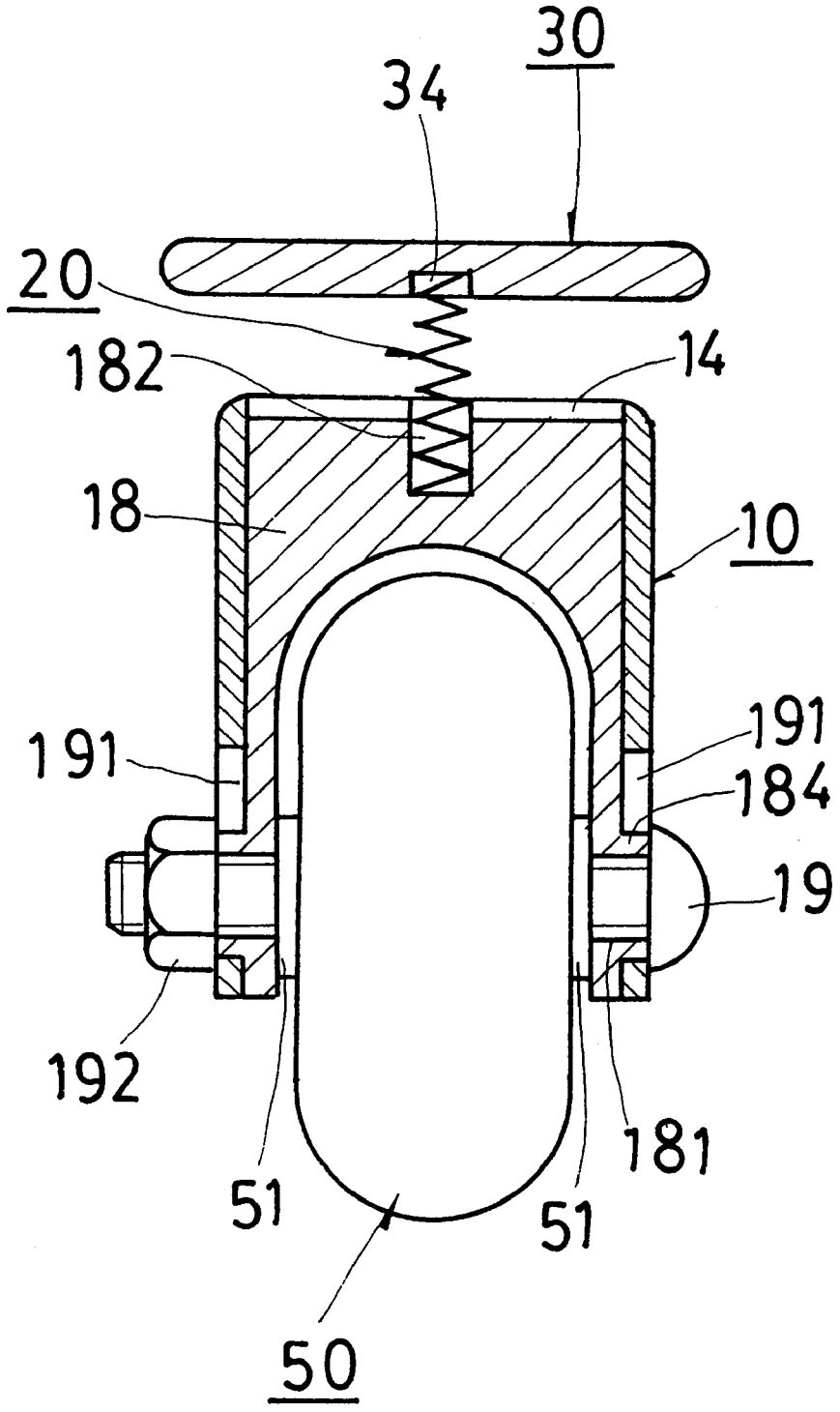
FIG. 5 is a schematic illustration showing the structure of the present invention.

With reference now to FIG. 2, the wheel bracket 10 is subjected to a shocking force when it encounters pits or shingles. At this time, the spring 20 and the U-shape member 18 arranged between the wheel bracket 10 and the mounting plate 30 can adjust to minimize the shocking force. As shown in FIG. 4 and 5, the rectangular shaft 3 1 below the mounting plate 30 will be clamped by the positioning shaft hole 13 within the embedding groove 11. Moreover, the slot 32 upon the rectangular shaft 31 is penetrated by the positioning rod 16, and the fixing plate 33 clamps the positioning plate 12 such that the mounting plate 30 will not move slantingly within the embedding groove 11. The mounting plate 30 can be kept its stability by minimizing the shocking force of the wheel bracket 10 with the help of the elastic force of the spring 20 and the shift of the U-shape member 18 within the rectangular groove 14.

Figure 6:
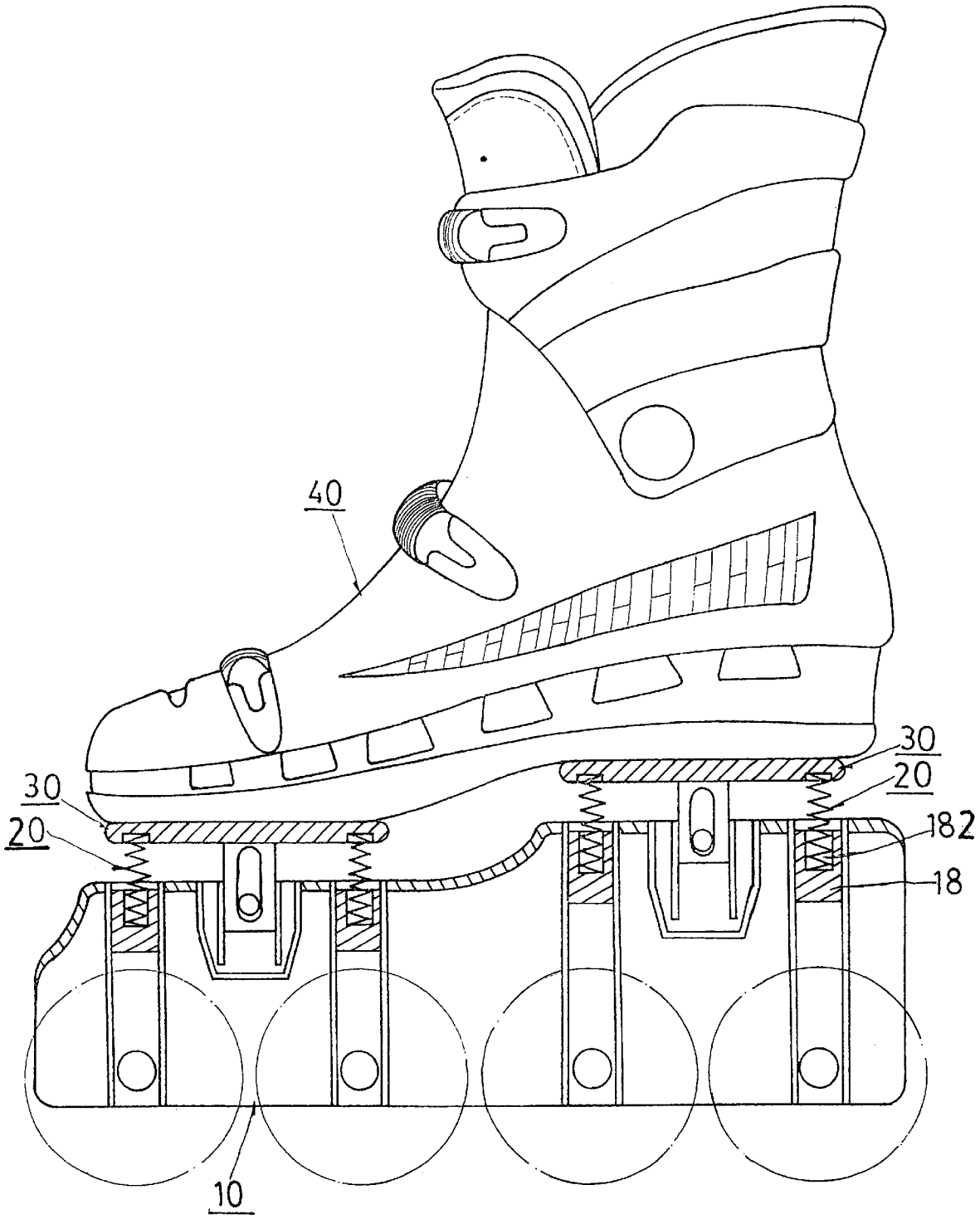
FIG. 6 is a schematic cross section view showing the arrangement of the skating stage on skate means.

As shown in FIG. 6, after mounting a skating shoe 40 on the mounting plate 30 according to the present invention; the skating shoe 40 has an excellent anti-shocking effect due to the spring 20 between the wheel bracket 10. In particularly, as the wheel bracket 10 is being subjected to a shocking force, the skating shoe 40 on the mounting plate 30 according to the present invention can be stabilized by the elasticity of spring 20 and in downward shift of U-shape member 18 within the rectangular groove 14.

While a particular embodiment of the present utility has been illustrated and described, it would be obvious to those skilled in the art that various other changes and modifications can be made without departing from the spirit and scope of the invention. It is therefore intended to cover in the appended claims all such changes and modifications that are within the scope of the present invention.

I claim:

1. A shock absorber for a skate comprising:

a) a wheel bracket including at least one embedding groove formed in a top side thereof, a rectangular groove formed on each of two opposite sides of the embedding groove, each rectangular groove including a plurality of blocking pieces therein, the embedding groove including a positioning shaft hole and a plurality of positioning plates therein, the positioning shaft hole being defined by a pair of spaced lateral walls having a pair of aligned lateral holes formed therethrough, and the bracket further including at least two pairs of aligned bracket axle holes formed therethrough;

b) at least one mounting plate including a bottom side having a rectangular shaft extending therefrom, a slot formed in the shaft, a fixing plate on each of two opposite sides of the shaft, and a pair of recesses formed in the bottom side;

c) a pair of U-shaped members, each member including a round groove and a pair of blocking grooves at a top side thereof, and a pair of convex axle holes extending outwardly from a bottom side thereof;

d) the rectangular shaft of the mounting plate being disposed within the positioning shaft hole of the wheel bracket, a positioning rod secured through the aligned lateral holes of the bracket and slot of the shaft, the fixing plates of the shaft clamping the positioning plates of the embedding groove, thereby limiting and positioning the movement of the shaft within the shaft hole;

e) each U-shaped member being disposed within a rectangular groove of the wheel bracket, the blocking pieces of the rectangular groove engaging the blocking grooves of the member, the convex axle holes of the two members being engaged within the two pairs of bracket axle holes of the bracket, and an axle bolt secured through each two aligned pairs of convex axle and bracket axle holes; and f) a spring disposed between each recess of the mounting plate and the round groove of each U-shaped member for providing elasticity between the mounting plate and the wheel bracket and permitting the rectangular shaft to move back and forth within the positioning shaft hole in response to shock transmitted thereto.

* * * * *